US012612830B1

(12) United States Patent
Nagarajan et al.

(10) Patent No.: US 12,612,830 B1
(45) Date of Patent: Apr. 28, 2026

(54) AUTOMATIC DRILL BIT CHANGING MAGAZINE

(71) Applicant: Caterpillar Global Mining Equipment LLC, Denison, TX (US)

(72) Inventors: Ravi Kumar Nagarajan, Chennai (IN); William Frisbey, Dallas, TX (US); Scott Alan Christianson, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 19/238,638

(22) Filed: Jun. 16, 2025

(51) Int. Cl.
*E21B 19/18* (2006.01)
*E21B 10/62* (2006.01)

(52) U.S. Cl.
CPC ..... *E21B 19/18* (2013.01); *E21B 10/62* (2013.01)

(58) Field of Classification Search
CPC ..... E21B 19/18; E21B 19/20; E21B 10/62
See application file for complete search history.

(56) References Cited

U.S. PATENT DOCUMENTS

| | | | | |
|---|---|---|---|---|
| 9,523,269 | B2 * | 12/2016 | Hoult | E21B 44/00 |
| 11,261,677 | B2 | 3/2022 | Hellman | |
| 11,898,406 | B2 | 2/2024 | Fosler et al. | |
| 2010/0071958 | A1 * | 3/2010 | Bienfang | E21B 19/18 175/85 |
| 2017/0101860 | A1 * | 4/2017 | Nieminen | E21B 7/025 |
| 2017/0234087 | A1 * | 8/2017 | Gaska | E21B 19/18 175/85 |
| 2021/0198960 | A1 * | 7/2021 | Branson | E21B 10/00 |
| 2021/0355767 | A1 | 11/2021 | Amerson et al. | |
| 2022/0243542 | A1 * | 8/2022 | Fosler | E21B 19/18 |
| 2024/0328264 | A1 * | 10/2024 | Frade | E21B 19/15 |
| 2025/0146370 | A1 * | 5/2025 | Bizama Almendras | E21B 19/14 |

FOREIGN PATENT DOCUMENTS

| | | | |
|---|---|---|---|
| CN | 203726256 | U | 7/2014 |
| CN | 214186363 | U | 9/2021 |
| WO | 2023028033 | A1 | 3/2023 |

* cited by examiner

*Primary Examiner* — Yanick A Akaragwe

(57) ABSTRACT

A magazine for auto drill-bit changes including a housing. The housing includes a first and second housing guide and at least two drill-bit pockets. The magazine also includes a bracket, an actuator, and a lid dimensioned to enclose the housing. The housing and lid pivotally coupled to the bracket, wherein the housing is actuatable between a parked, closed position and an open, tilted position when the actuator transitions from a first state to a second state. The lid includes a guide plate disposed on an underside of the lid. When the housing is in the parked position, the first and second housing guides engage the second portion of the guide plate and, when the housing is in the open, tilted position, the first guide engages the second portion of the guide.

15 Claims, 12 Drawing Sheets

AUTOMATIC DRILL BIT CHANGING MAGAZINE

TECHNICAL FIELD

The embodiments described herein are generally directed to drilling machinery, and, more particularly, to an automatic drill bit changing magazine.

BACKGROUND

During a drilling operation (e.g., drilling surface rock) by a drilling rig, the drill bit needs to be changed from time to time. To change the drill bit, the used drill bit must be removed from the drill string, the used drill bit must be stored, and a new drill bit must be installed on the drill string. Ideally, for the sake of efficiency and safety, this process would be done without direct human intervention.

SUMMARY

Disclosed herein is a magazine for auto drill-bit changes. The magazine includes a housing, defining a volume. The housing includes: at least one sidewall defining an interior volume, a first housing guide, a second housing guide, and at least two drill-bit pockets disposed within the volume of the housing. The magazine also includes a bracket having a first end and a second end, the housing pivotably coupled to the first end of the bracket. Additionally, the magazine also includes an actuator pivotably coupled to both the sidewall of the housing and the bracket, the first actuator actuatable between a first state and a second state. Further, the magazine also includes a lid dimensioned to enclose the housing, the lid pivotably coupled to the second end of the bracket. The magazine also includes a guide plate disposed on an underside of the lid having a first portion with a first height and a second portion, spaced apart from the first portion, having a second height smaller than the first height. In preferred examples, the housing is actuatable between a parked, closed position and an open, tilted position when the actuator transitions from the first state to the second state. Further, when the housing is transitioning from the parked, closed position to the tilted, open position, the first and second portions of the guide plate engage the first and second housing guides and, when the housing is in the open, tilted position, the first portion of the guide plate engages the second housing guide.

Also disclosed herein is a drilling rig. The drilling rig includes a machine body including a platform that defines a reference axis. The drilling rig also includes a mast attached to the machine body and configured to tilt a drill between a range of angles with respect to the reference axis. The range of angles includes a first angle and a second angle. The drilling rig can also include one or more ground-engaging members configured to facilitate the drill engaging a ground. The drilling rig can also include the magazine for auto drill bit changes. In preferred examples, the magazine is attached to the platform and each of the one or more ground engaging members are disposed in one of the drill-bit pockets.

A method of auto-changing a drill bit. The method includes determining, via a controller, to change a used drill bit with a new drill bit disposed in the magazine for auto drill bit changes. The method also includes activating the actuator of the magazine to transition the housing from the parked position to the open, tilted position. Further, in response to determining to change the used drill bit, the method includes: selecting an empty one of the plurality of drill-bit pockets of the magazine; controlling the mast to tilt the drill to an angle, with respect to the reference axis, that matches an angle of the selected empty drill-bit pocket; operating a drill string of the drill to release the used drill bit into the selected empty drill bit pocket. Additionally, the method then includes: selecting an occupied one of the plurality of drill-bit pockets in the magazine; controlling the mast to tilt the drill to an angle, with respect to the reference axis, that matches an angle of the selected occupied drill-bit pocket; and operating the drill string of the drill to engage a new drill bit held by the selected occupied drill-bit pocket.

BRIEF DESCRIPTION OF DRAWINGS

The details of embodiments of the present disclosure, both as to their structure and operation, may be gleaned in part by study of the accompanying drawings, in which like reference numerals refer to like parts, and in which.

DETAILED DESCRIPTION

Figure 1:
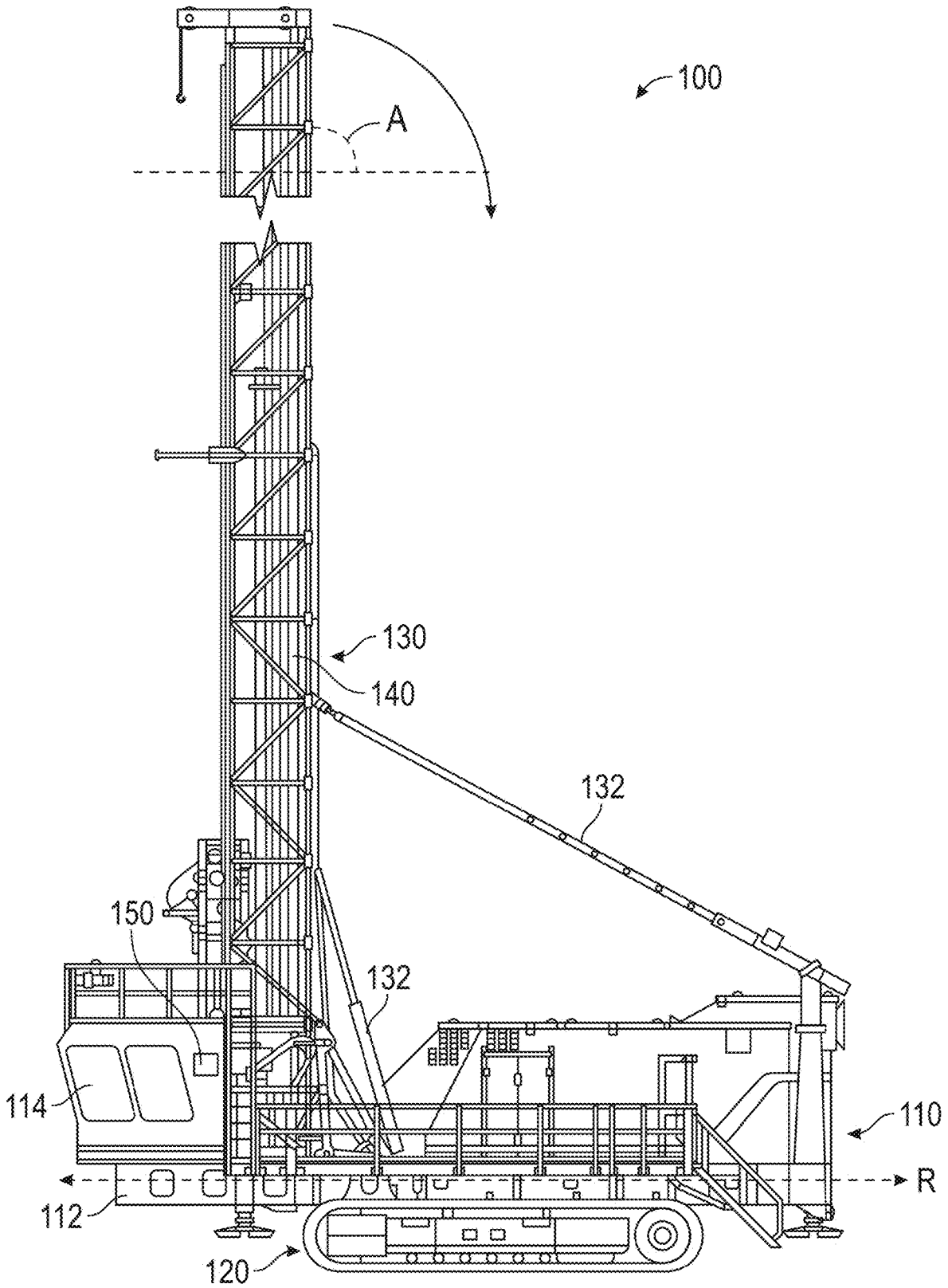
FIG. 1 illustrates a side view of a drilling rig, according to an embodiment.

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details.

In some instances, well-known structures and components are shown in simplified form for brevity of description. For clarity and ease of explanation, some surfaces and details may be omitted in the present description and figures. It should also be understood that the various components illustrated herein are not necessarily drawn to scale. In other words, the features disclosed in various embodiments may be implemented using different relative dimensions within and between components than those illustrated in the drawings.

The terms "side," "top," "bottom," "front," "rear," "above," "below," and the like are used for convenience of understanding, to convey the relative positions of various components with respect to each other, and do not imply any specific orientation of those components in absolute terms (e.g., with respect to the external environment or the ground). In addition, the terms "respective" and "respectively" signify an association between members of a group of first components and members of a group of second components. For example, the phrase "each component A connected to a respective component B" would signify A1 connected to B1, A2 connected to B2, . . . and AN connected to BN. Furthermore, a reference numeral with an appended letter will be used herein to refer to a specific component, whereas the same reference numeral without any appended letter will be used to refer collectively to a plurality of the component or to refer to a generic or arbitrary instance of the component. Similarly, a reference letter with an appended number will be used herein to refer to a specific parameter, whereas the same reference letter without any appended number will be used to refer collectively to a plurality of the parameter or to refer to a generic or arbitrary instance of the parameter.

Drilling Rig

FIG. 1 illustrates a side view of a drilling rig 100, according to an embodiment. Drilling rig 100 comprises a machine body 110, which includes a platform 112 that is supported off the ground by one or more ground-engaging member(s) 120. Platform 112, which may also be referred to as a "drill deck," defines a reference axis R. Examples of drilling rig 100 include any of the rotary drills (e.g., models numbers MD6200, MD6240, MD6250, MD6290, MD6310, MD6380, MD6420C, MD6540, MD6540C, MD6640, etc.) manufactured by Caterpillar Inc. of Irving, Texas or other manufacturers. However, it should be understood that disclosed embodiments may be applied to any drilling rig with a drill capable of being rotated through a plurality of angles.

Platform 112 may support a cabin 114, a mast 130, an internal combustion engine or electric motor (not shown), and other various components of machine body 110. Cabin 114 may be configured to accommodate a local human operator and may comprise one or more machine controls, by which the local human operator may control one or more subsystems of drilling rig 100. In an alternative embodiment, such as in the case of an autonomous or remotely controlled drilling rig 100, cabin 114 may be omitted.

Ground-engaging member(s) 120, which may be driven by an internal combustion engine or electric motor in machine body 110, are configured to move machine body 110 with respect to the ground. Ground-engaging member(s) 120 are illustrated as a pair of tracks on either side of machine body 110. However, in an alternative embodiment, ground-engaging member(s) 120 may comprise a plurality of (e.g., four or more) wheels or the like.

Mast 130 supports a drill 140. Drill 140 may comprise components that are configured to move, relative to mast 130, so as to extend towards and into the ground below machine body 110. For example, drill 140 may comprise a drill string (illustrated in FIG. 3) with a drill bit attached to a drilling end. The drill string may extend outwards from a cylinder to drill into the ground using the drill bit.

Mast 130 is attached to machine body 110 and configured to rotate or tilt drill 140 between a range of angles with respect to reference axis R. In an embodiment, the orientation of drill 140 is fixed relative to mast 130, and mast 130 is itself configured to rotate or tilt between the range of angles with respect to reference axis R, to thereby tilt drill 140 via the fixation between mast 130 and drill 140. For example, mast 130 may be configured to tilt backwards (e.g., towards the rear of machine body 110) via one or more hydraulic supports 132. In particular, hydraulic supports 132 may be configured to retract (e.g., by reducing hydraulic pressure within the respective hydraulic cylinder) to tilt mast 130 down, and extend (e.g., by increasing hydraulic pressure within the respective hydraulic cylinder) to tilt mast 130 up. In an alternative embodiment, other means may be used to tilt mast 130 through the range of angles.

In the illustrated example, the angle A of mast 130, relative to reference axis R, is 90 degrees (°), which may be an upper limit of the range of angles of mast 130. Mast 130 may be configured to tilt down to a 0° angle, such that mast 130 is lying horizontally on platform 112. In this case, the range of angles is from 0° to 90°. Mast 130 may be fixable at each of a plurality of angles within the range of angles (e.g., via a locking mechanism), to thereby fix both mast 130 and drill 140 at that angle. Once fixed at a particular angle with respect to reference axis R, drill 140 may be operated to drill into the ground at that angle.

Drilling rig 100 may comprise a controller 150 that is configured to perform one or more of the processes described herein, including automatically changing drill bits (as will be discussed in greater detail in connection with FIGS. 9-11). While controller 150 is illustrated in a particular location on machine body 110, it should be understood that controller 150 may positioned in any alternative location on drilling rig 100, as may be dictated by one or more design factors. In addition, while controller 150 is illustrated as a single unit, controller 150 may, in practice, comprise a plurality of separate, but communicatively coupled, control units, distributed at various positions throughout drilling rig 100.

Controller 150 may be an electronic control unit (ECU) that controls one or more subsystems of drilling rig 100 (e.g., the engine or motor driving ground-engaging member(s) 120, hydraulic supports 132 of mast 130, the drill string of drill 140, etc.). Control may be provided by a local human operator (e.g., via machine control(s) in cabin 114), a remote human operator (e.g., via a remote terminal that is communicatively coupled to controller 150 via a wireless communication interface), and/or by an autonomous system (e.g., implemented by controller 150 or other control systems onboard drilling rig 100, or remote from drilling rig 100 and communicatively coupled to controller 150 via a wireless communication interface). Of particular relevance to disclosed embodiments, the control may comprise controlling mast 130 (e.g., via hydraulic supports 132) to tilt drill 140 to a particular angle A with respect to reference axis R.

Figure 2:
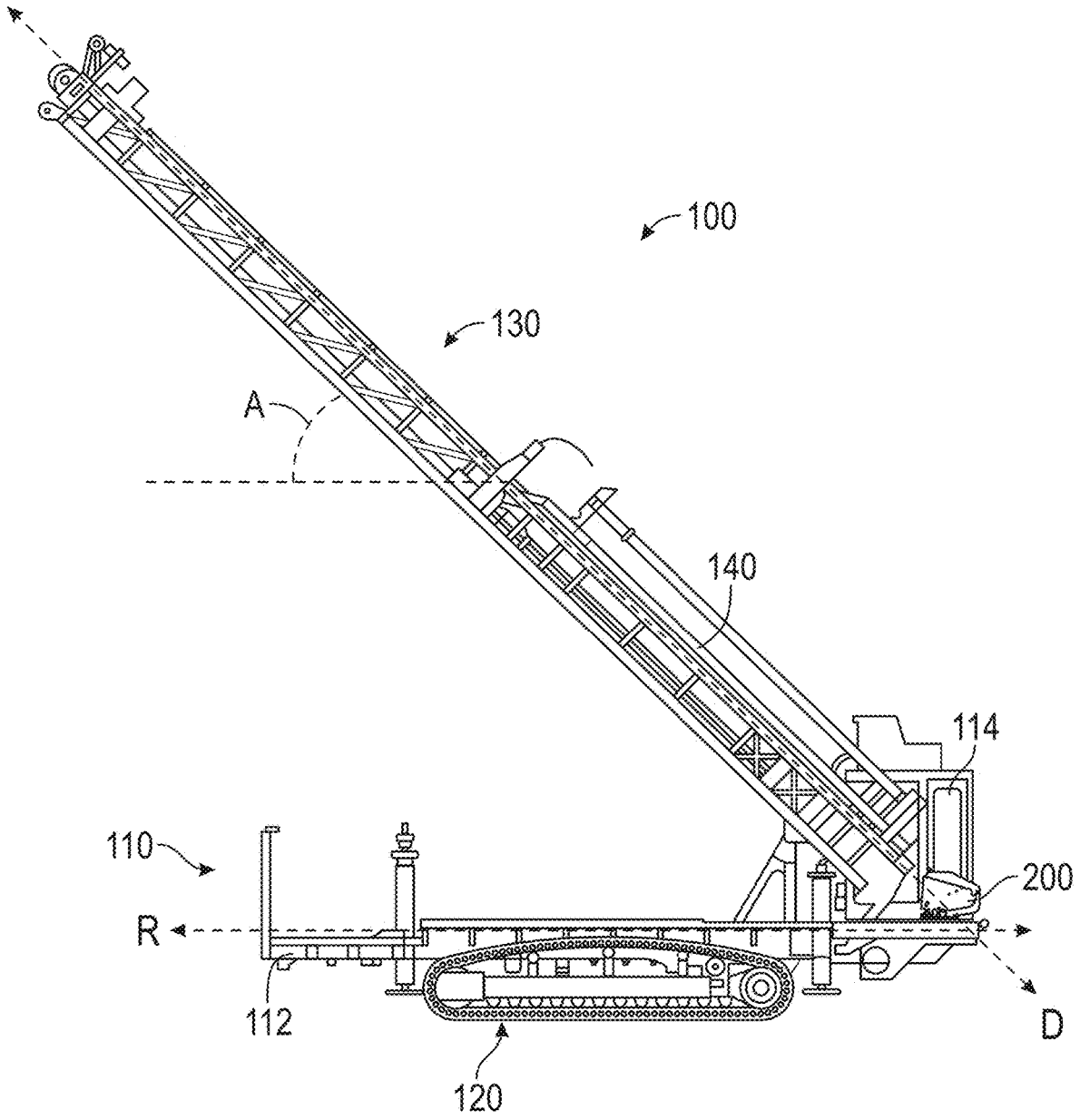
FIG. 2 illustrates a side view of a partial assembly of a drilling rig, according to an embodiment.

FIG. 2 illustrates a side view of a partial assembly of drilling rig 100, according to an embodiment. In this view, which is from the other side of drilling rig 100 as in FIG. 1, portions of machine body 110 have been removed, to more clearly illustrate components that are relevant to disclosed embodiments. As illustrated, mast 130, including drill 140 fixed therein, can be tilted to an angle A, between 0° and 90° (e.g., approximately 45° in the illustrated example).

A magazine 200 (described in greater detail in connection with FIGS. 5-8) may be attached to platform 112 of machine body 110. Magazine 200 may be positioned on platform 112, such that, when drill 140 is tilted within a sub-range of possible angles, a drill axis D of drill 140 intersects magazine 200. In an embodiment in which drill 140 tilts towards the rear of machine body 110, magazine 200 may be attached to a front end of platform 112, whereas, in an alternative embodiment in which drill 140 tilts towards the front of machine body 110, magazine 200 may be attached to a rear end of platform 112. Magazine 200 may be positioned near cabin 114, such that magazine 200 is easily accessible to a local operator of drilling rig 100. For example, magazine 200 may be positioned on a lateral side of cabin 114. As used herein, the term "lateral" should be understood to mean a horizontal orientation that is orthogonal to reference axis R.

Figure 3:
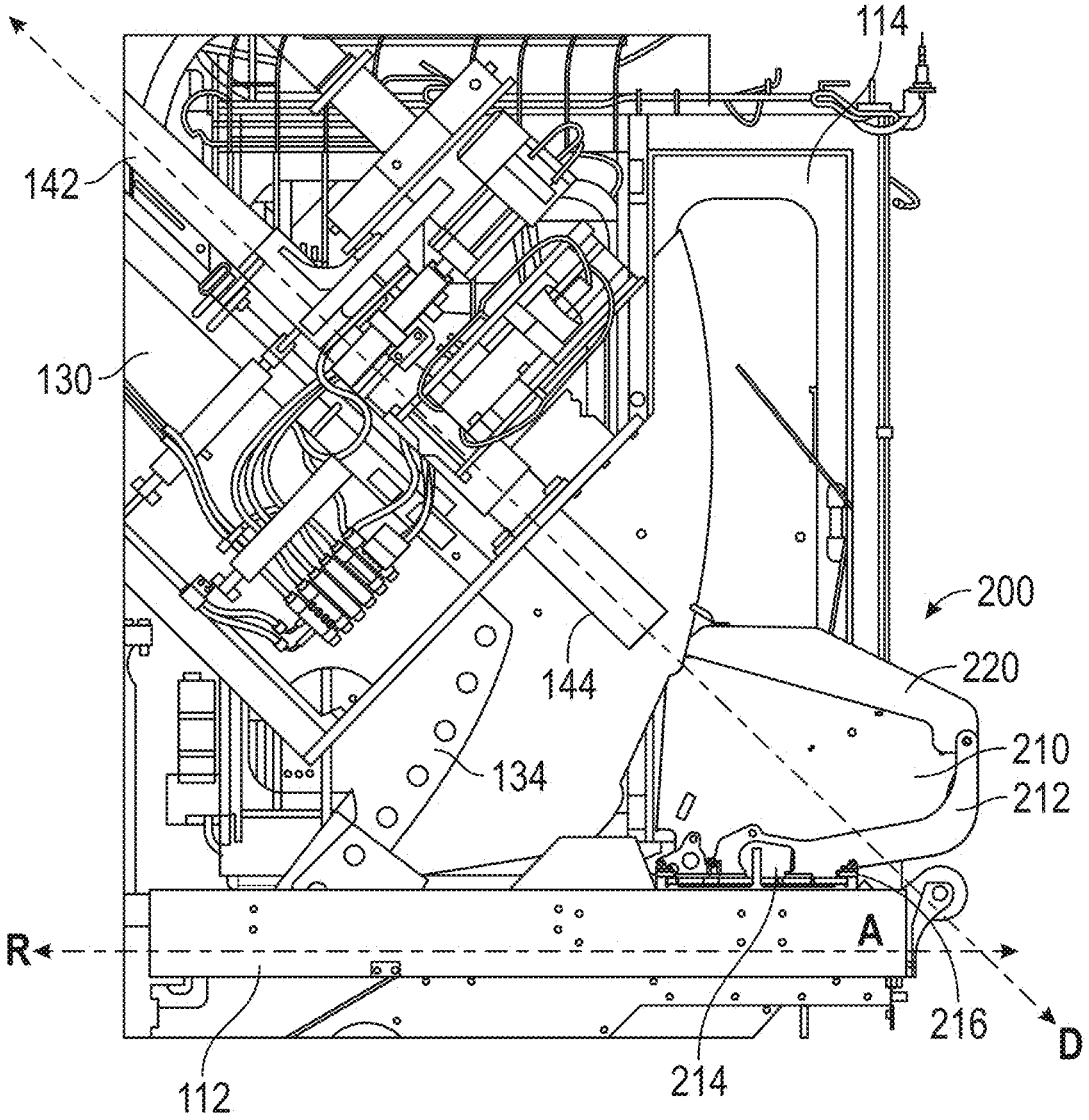
FIG. 3 illustrates a close-up side view of a partial assembly of a drilling rig, according to an embodiment.

FIG. 3 illustrates a close-up side view of a partial assembly of a drilling rig 100, according to an embodiment. Mast 130 may comprise a locking mechanism 134 that enables mast 130 to be locked at an angle A with respect to reference axis R. For example, locking mechanism 134 may comprise a plurality of lateral apertures, and platform 112 may comprise a corresponding lateral aperture (not shown), which is configured to align with each of the plurality of lateral apertures of locking mechanism 134, depending on angle A of mast 130. When the lateral aperture of platform 112 is aligned with one of the plurality of lateral apertures of locking mechanism 134, a pin may be inserted through both lateral apertures to thereby lock mast 130, and drill 140 by virtue of its fixation to mast 130, at angle A. Locking mechanism 134 may be used during normal drilling operations. However, in an embodiment, locking mechanism 134 is not used during the automated changing of drill bits.

Drill 140 may comprise a hollow, hydraulically operated drill cylinder 142 that actuates a drill string 144. Drill string 144 may be configured to extend and retract parallel to drill cylinder 142, along drill axis D. Drill string 144 may extend and retract based on the pressure of hydraulic fluid, contained within drill cylinder 142, that is applied to the end of drill string 144 through a wire rope and sheave mechanism or any other suitable mechanism. This hydraulic pressure and/or the travel of drill string 144 may be controlled by controller 150.

Within a sub-range of angles, drill axis D may intersect with magazine 200. Thus, when angle A of drill 140 is within this sub-range of angles, drill string 144 may be extended towards magazine 200 to interact with magazine 200 and/or retracted away from magazine 200 when the interaction with magazine 200 is completed. In this manner, drill string 144 may be operated to release used drill bits into magazine 200 and engage new drill bits held within magazine 200. In preferred examples, as discussed below in connection with FIG. 11, the drill 140 interacts with the magazine 200 when the magazine 200 is in the tilted, open position.

Magazine 200 is configured to hold a plurality of drill bits for the automated changing of drill bits on drilling rig 100. Magazine 200 may comprise a housing 210 and a magazine lid 220. The housing 210 is defined by at least one sidewall to define an interior volume. In the present example, the magazine 200 has a rectangular planform shape. In various other examples, the magazine could be triangular, hexagonal, or any other planform shape. Additionally, in preferred examples, the magazine lid 220 is made of lightweight materials to facilitate smooth operation of the magazine 200. Additionally, the lightweight lid allows a single person to manually operate the lid 220 for ordinary maintenance and restocking. In some examples, the lid 220 can be made of lightweight metal (e.g., aluminum) or polymer (e.g., plastic).

Housing 210 may be supported on platform 112 via a bracket 212. Bracket 212 may include a plate 214 that is configured to engage the platform 112 or another securement mechanism. Alternatively, bracket 212 may comprise other means for attaching or otherwise engaging housing 210 with platform 112. In an alternative embodiment, bracket 212 may be omitted, in which case housing 210 may be mounted directly on platform 112. In any case, bracket 212 and/or another mechanism of magazine 200 may be configured to fix housing 210 to platform 112 of drilling rig 100.

As shown in FIG. 3, the plate 214 of the bracket 212 engages with a securing channel 216. The securing channel 216 includes two, opposing C-channels spaced apart to secure the plate 214 The securing channel 216 may be oriented along a lateral axis that is horizontal parallel to the platform 112. The plate 214 is configured to slidably engage (e.g., attach) within the securing channel 216, such that magazine 200 slides into securing arrangement with the platform 112. In some examples, the magazine 200 is movable side-to-side within the securing channel 216 via hydraulic or electric actuators. The magazine 200 can be actuatable to improve alignment with the drill axis D.

Drill Bit

Figure 4:
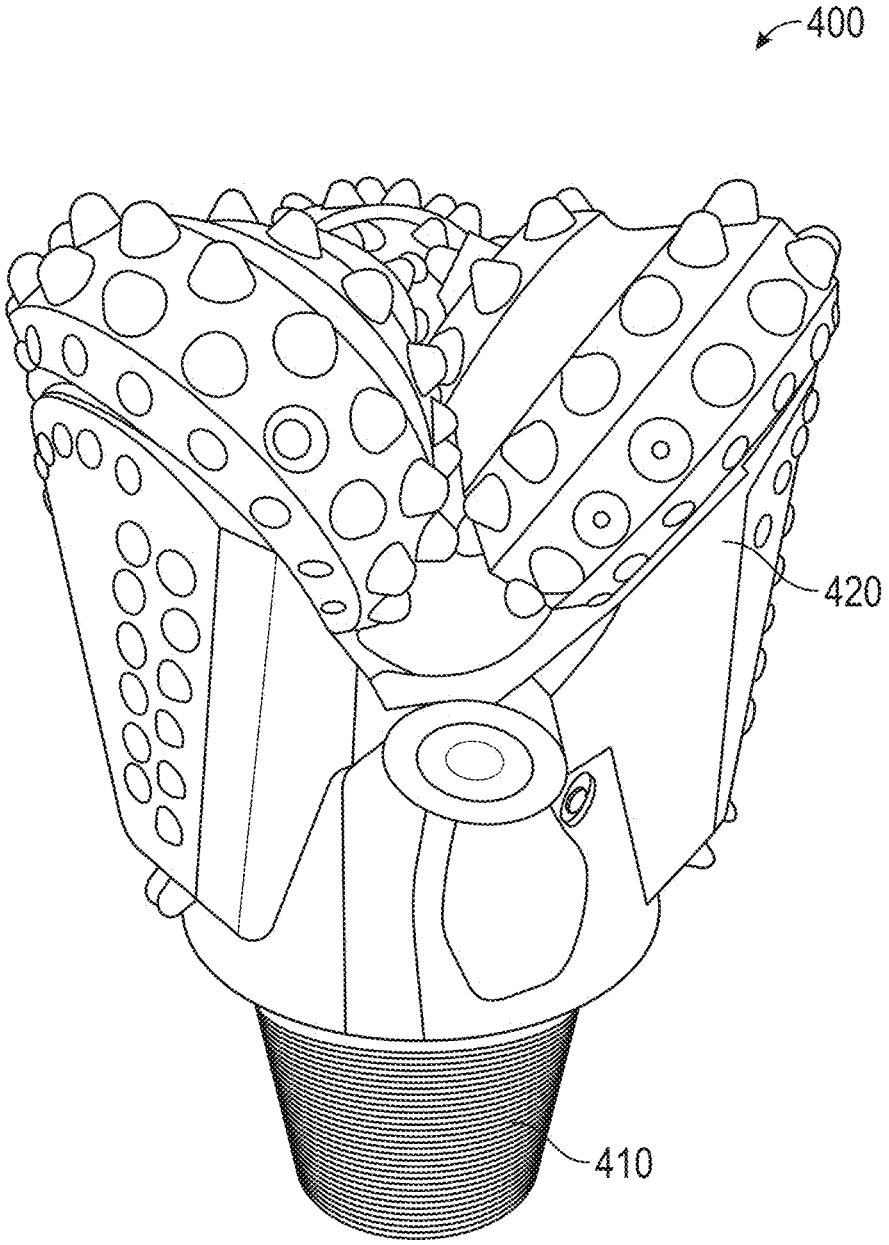
FIG. 4 illustrates a drill bit, according to an example.

FIG. 4 illustrates an example drill bit 400. Each drill bit 400 comprises an engagement end 410 and a drilling end 420. Engagement end 410 may be configured to engage with drill string 144. In particular, engagement end 410 may comprise a shank that is configured to be inserted within a socket on the drilling end of drill string 144. Alternatively, engagement end 410 could comprise a socket that is configured to receive the drilling end of drill string 144. In either case, an attachment and/or release mechanism may be used to respectively fix drill bit 400 to drill string 144 and unfix drill bit 400 from drill string 144. Any suitable mechanism may be used as the attachment and/or release mechanism.

In the illustrated embodiment, drilling end 420 comprises three rotating teeth. However, it should be understood that drilling end 420 of drill bit 400 may comprise any suitable mechanism(s) for drilling into a material surface. Different types of drill bits 400 may be specifically suited for different uses or materials. For example, one type of drill bit 400 may differ from another type of drill bit 400 in terms of size, drilling mechanism, and/or the like. Disclosed embodiments may operate with the same type of drill bit 400 or different types of drill bits 400.

Figure 5:
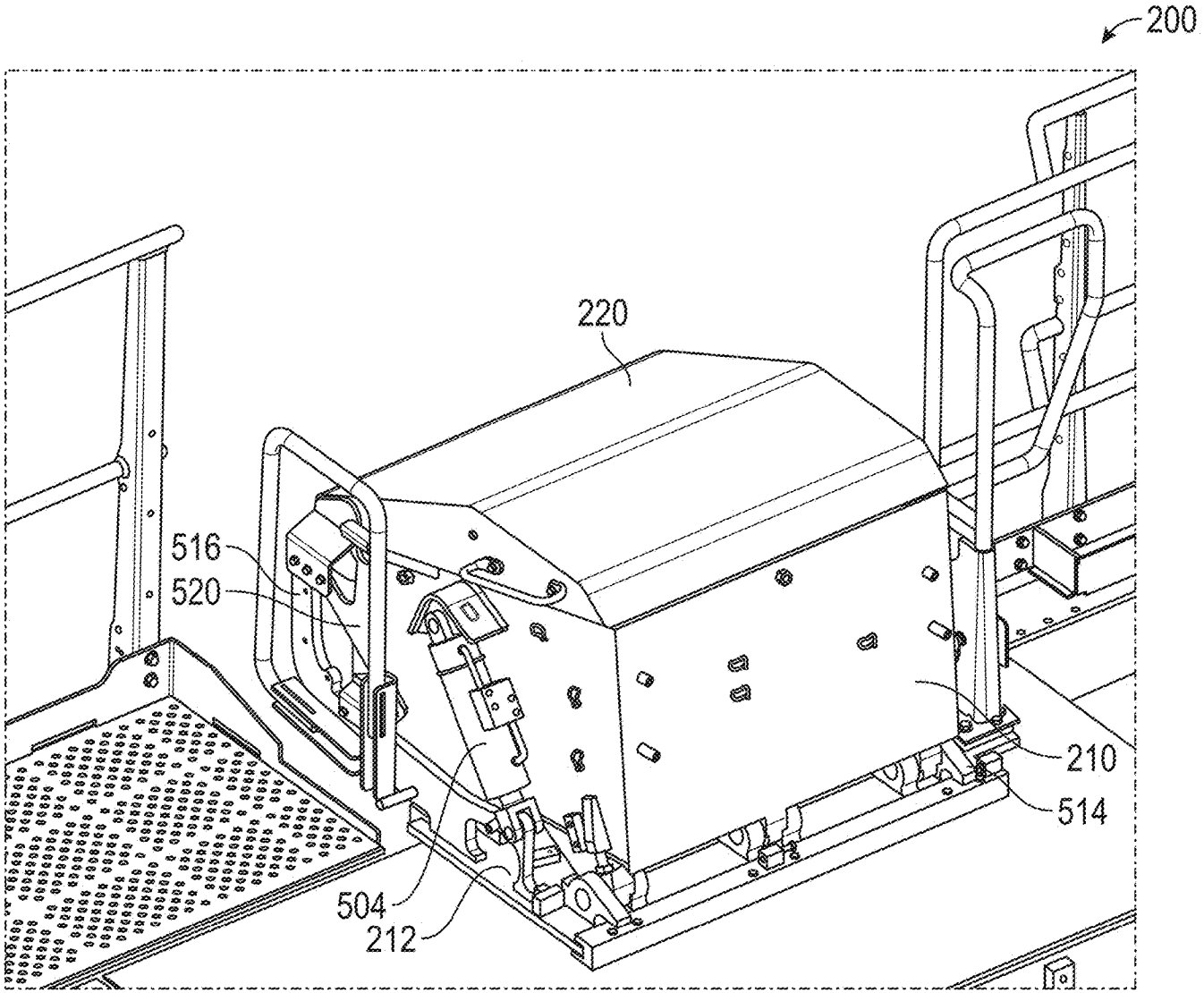
FIG. 5 illustrates a perspective view of an auto-bit changer magazine in accordance with the present disclosure.
Figure 6:
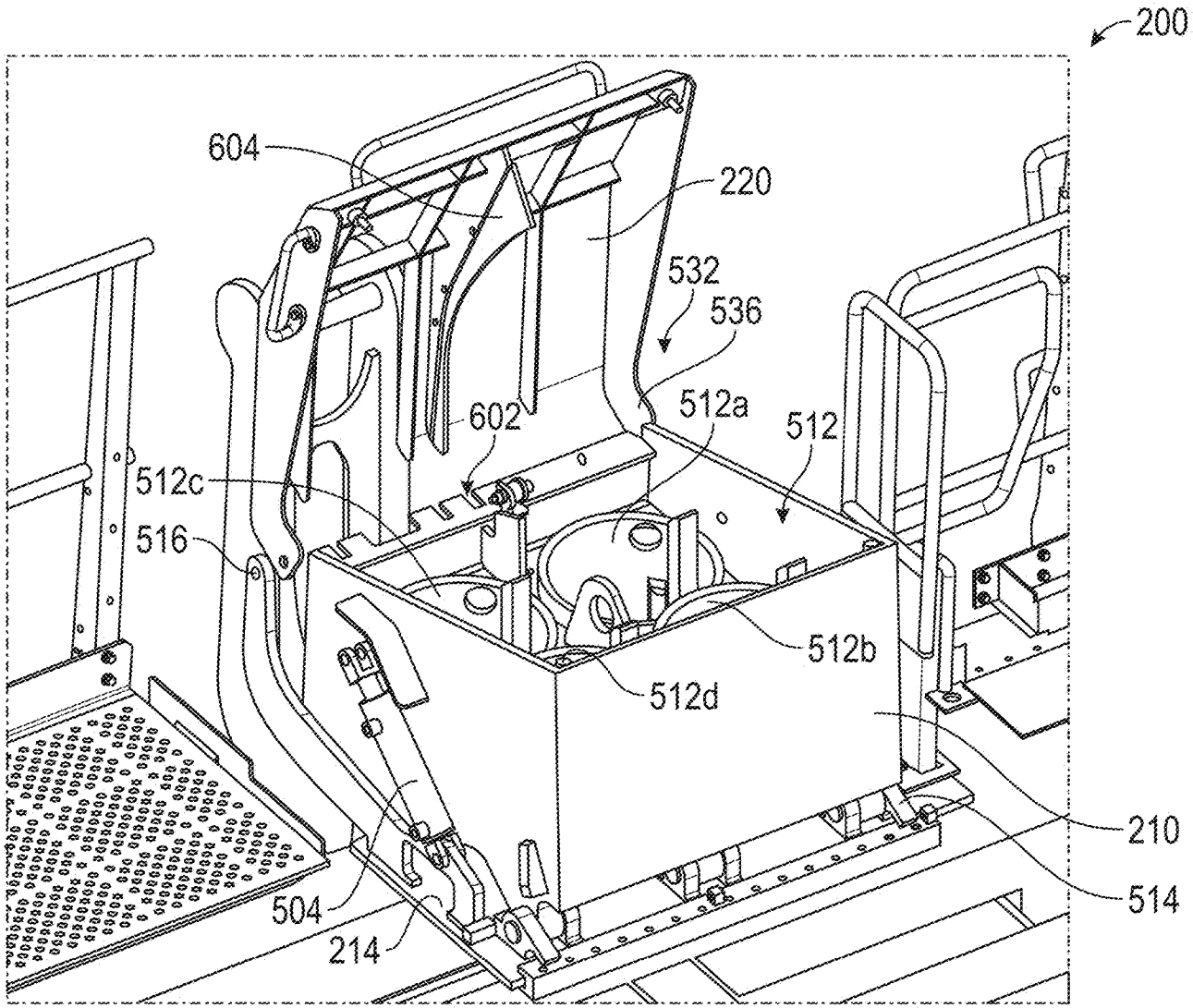
FIG. 6 illustrates a perspective view of an auto-bit changer magazine of FIG. 5 with an access door open.

Returning to the magazine 200, as shown in FIGS. 5 and 6, the magazine lid 220 is configured to open and close. In the open configuration (shown in FIG. 6), the magazine 200 provides access to the open end of each of the plurality of drill-bit pockets within housing 210. In the closed configuration (shown in FIG. 5), the lid 220 prevents access to the open end of each of the plurality of drill-bit pockets within housing 210 and protects the contents of the magazine from damage or environmental elements, such as dust, debris, and/or the like, damage from other mechanical components of drilling rig 100, and/or the like.

Magazine

FIG. 5 illustrates the magazine 200 in a closed state and FIG. 6 illustrates the magazine 200 in an example open, maintenance state. In this embodiment, the magazine 200 includes two actuators 504 (only one shown in FIGS. 5 and 6) on opposite sides of the housing 210. Further, the magazine 200 includes the bracket 212 pivotably coupled to both the housing 210 and the magazine lid 220. The housing 210 is pivotably coupled to the bracket 212 along hinge 514 disposed on a first end of the bracket 212 and the lid 220 is pivotably coupled to the bracket 212 along hinge 516 disposed on a second end of the bracket 212. In some examples, when the magazine 200 is in the closed state, the lid 220 rests on rubber or plastic bumpers to act as a door stopper and facilitate the lid 220 smoothly closing on the housing 210.

In the present example, the actuators 504 are linear hydraulic actuators having at least a first state, a second state, and a plurality of states therebetween. In the present example, the first state corresponds to a collapsed length and the second state corresponds to an expanded length. The actuators 504 are pivotally coupled to both the bracket 212 and the housing 210. The actuator 504 is pivotally coupled to the bracket 212 between the first end including the hinge 514 and the second end including the hinge 516. In other examples, the actuator(s) 504 could be any type of actuator including a pneumatic actuator or an electric motor. Additionally, in various examples, the magazine 200 could include more or fewer actuators.

In the present example, the hinge 514 is disposed on a first end of the bracket 212. The hinge 516 is disposed opposite the first hinge 514, on a second end of the bracket 212. In the present example, the first hinge 514 extends along the width of the magazine 200, but the hinge 516 includes two co-axial hinges. Alternatively, the housing 210 and bracket 212, as well as the lid 220 and the bracket 212 can be pivotally coupled with any known mechanical, pivotable connections.

Further, the magazine includes prop plate 520. The prop plate 520 is disposed adjacent the hinge 516 and configured to secure the lid 220 when the lid 220 is manually transitioned into an open configuration. As a result, the housing 210 can be manually opened and secured in the open configuration for reloading the magazine 200 or performing other maintenance on the magazine 200. In various other examples, the prop plate 520 can be configured to be a prop rod or other securing mechanism.

As shown in FIG. 6, the magazine 200 includes housing guides 602 (discussed in greater detail in connection with FIG. 7) and a guide plate 604 (discussed in greater detail in connection with FIG. 8) disposed on an underside of the lid 220. In the present example, the housing guides 602 and the guide plate 604 are positioned at approximately a midpoint between sidewalls. In other examples, the housing guides 602 and the guide plate 604 could be differently positioned on the magazine 200. In these various examples, the guide plate 604 is disposed on the underside of the lid 220 such that the guide plate 604 engages at least one of the housing guides 602 when the lid 220 transitions from the closed and open positions. More specifically, as will be discussed in greater detail in connection with FIGS. 9-11, the guide plate 604 slidably engages the housing guides 602 to facilitate opening the magazine 200 when the magazine 200 is tilted about the hinge 514.

Drill Bit Pockets

As shown in FIG. 6, the magazine 200 comprises at least one column of two or more drill-bit pockets 512, illustrated as first drill-bit pocket 512A and second drill-bit pocket 512B. As used herein, the term "column" refers to a plurality of vertically arranged drill-bit pockets 512. A vertical axis is one that is orthogonal to a plane of platform 112. Within a column, each drill-bit pocket 512 is at a different vertical position than any other drill-bit pocket 512. It should be understood that the drill-bit pockets 512 within a column may all be centered on the same vertical axis or may be offset from each other along reference axis R, so as to be centered on different vertical axes. In the illustrated embodiment, drill-bit pockets 512 are offset along reference axis R, so as to be centered on different vertical axes.

Each drill-bit pocket 512 has a closed end and an open end and is configured to receive at least a portion of drilling end 420 of drill bit 400, such that engagement end 410 of drill bit 400 is accessible at the open end of that drill-bit pocket 512. At least a portion of engagement end 410 of drill bit 400 may protrude from drill-bit pocket 512, and/or the diameter of drill-bit pocket 512 may be large enough to accommodate the outer diameter of the drilling end of drill string 144, such that drill string 144 can access engagement end 410 of drill bit 400 within drill-bit pocket 512. In either case, the drilling end of drill string 144 is able to access engagement end 410 of each drill bit 400 held in magazine 200.

Each drill-bit pocket 512 in magazine 200 may have the same size and shape as every other drill-bit pocket 512. In some examples, each drill-bit pocket 512 may be angled (relative to reference axis R as shown in FIG. 1) differently than other drill-bit pocket(s) 512 in the same column. Alternatively, one or more drill-bit pockets 512 may have a different size and shape than one or more other drill-pockets 512 within the same magazine 200.

In an embodiment, each drill-bit pocket 512 is configured to hold the same type of drill bit 400. In other words, magazine 200 may hold drill bits 400 of a single type. In an alternative embodiment, magazine 200 holds drill bits 400 of different types. In this case, each of one or more of the plurality of drill-bit pockets 512 in magazine 200 may be configured to hold a different type of drill bit 400 than at least one other one of the plurality of drill-bit pockets 512 in magazine 200. It should be understood that drill bits 400 of different types may have different uses. For example, a drill bit 400 of a first type may be configured to drill through a different type of material than a drill bit 400 of a second type, drill a larger hole than a drill bit 400 of the second type, and/or the like.

While magazine 200 is illustrated with a column consisting of two drill-bit pockets 512, it should be understood that each column in magazine 200 may comprise any feasible number of drill-bit pockets 512, including three or more laterally arranged drill-bit pockets 512. For example, magazine 200 may be expanded in length and/or width to include one or more additional drill-bit pockets 512, positioned adjacent first drill-bit pocket 512A and/or adjacent second drill-bit pocket 512B within the column.

Magazine 200 may consist of a single column of drill-bit pockets 512. Alternatively, in some embodiment the magazine can include rail(s) or another mechanism for laterally sliding magazine 200, magazine 200 may comprise a plurality of columns of drill-bit pockets 512. In this case, magazine 200 will comprise both lateral rows and lateral columns of drill-bit pockets 512, with each row comprising two or more drill-bit pockets 512 and each column comprising two or more drill-bit pockets 512. Within a row, each drill-bit pocket 512 in the row may hold a drill bit 400 at the same angle as every other drill-bit pocket 512 in that row. Conversely, within a column, each drill-bit pocket 512 in the column may hold a drill bit 400 at a different angle than every other drill-bit pocket 512 in that column. In some examples, lower drill-bit pockets 512 in the column having a larger angle than higher drill-bit pockets 512 in the column.

The plurality of drill-bit pockets 512 in magazine 200 may comprise two or more rows of laterally arranged drill-bit pockets 512. In the illustrated embodiment, magazine 200 consists of two rows of drill-bit pockets 512. These rows are illustrated as a first row comprising drill-bit pockets 512A and 512C and a second row comprising drill-bit pockets 512B and 512D, with the second row positioned adjacent the first row. In the first row, all of the drill-bit pockets 512 (i.e., 512A and 512C in the illustrated embodiment) hold drill bits 400 (i.e., 400A and 400C in the illustrated embodiment) at a first angle, and, in the second row, all of the drill-bit pockets 512 (i.e., 512B and 512D in the illustrated embodiment) hold drill bits 400 (i.e., 400B and 400D in the illustrated embodiment) at a second angle. The second angle is smaller than the first angle.

Housing Guides

Figure 7:
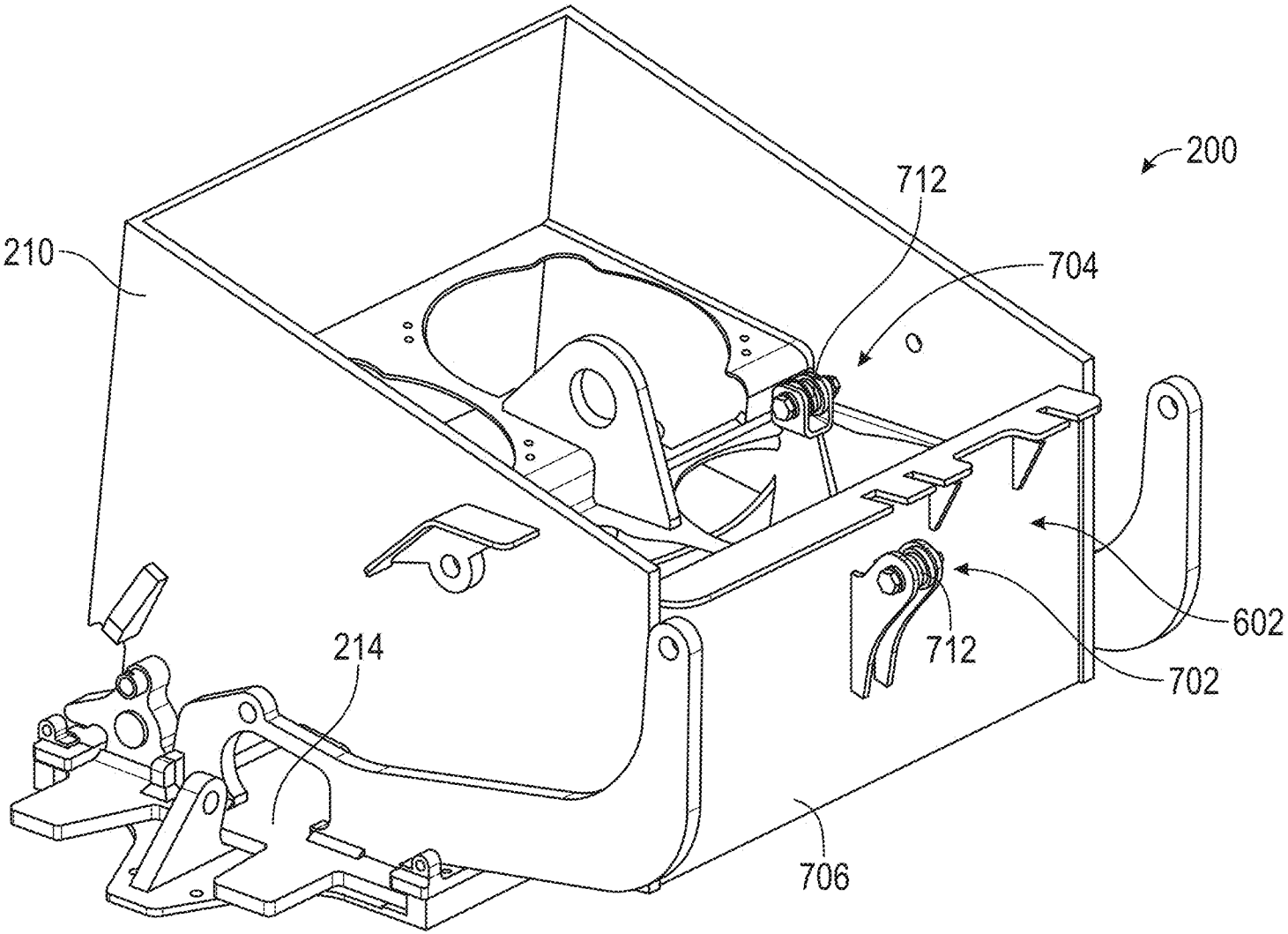
FIG. 7 is a rear perspective view of the auto-bit changer magazine of FIGS. 5 and 6.

As shown in FIG. 7, the housing guides 602 of the magazine 200 include a first housing guide 702 and a second housing guide 704. FIG. 7 illustrates the magazine 200 without the lid 220 to improve clarity of the first and second housing guides 702, 704. In the present example, the first housing guide 702 is coupled to an inner side of a rear sidewall 706 and the second housing guide 704 is coupled to an outer side of the rear sidewall 706. In various other examples, the first and second housing guides 702, 704 could be coupled to other sidewalls of the housing 210 of the magazine 200. Additionally, the magazine 200 can include more or fewer housing guides 602 than shown in FIG. 7.

In the present example, each of the first and second housing guides 702, 704 includes a bushing 712. The bushings 712 reduce the friction of the guide plate 604 sliding over the first and second housing guides 702, 704. In the present example, each bushing 712 is adapted to roll about a low-friction roller bearing (not shown). In other examples, each bushing 712 could be manufactured from a hard, low-friction material to minimize friction between the first and second housing guides 602 and the guide plate 604.

Guide Plate

Figure 8:
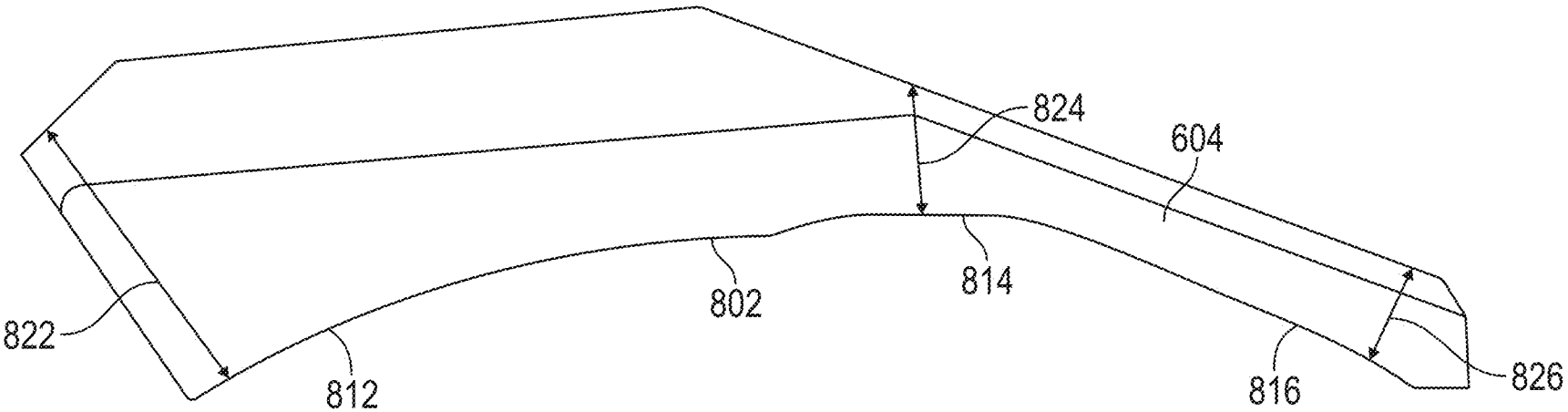
FIG. 8 is a side view of a guide plate of the auto-bit changer magazine of FIG. 5.

FIG. 8 illustrates the guide plate 604 in greater detail. In the present example, the guide plate 604 is made from steel, but could be made from another material including other metals (e.g., aluminum), polymers (e.g., polyvinyl chloride (PVC), epoxy), or natural materials (e.g., wood). The guide plate 604 includes an engagement surface 802 that engages the housing guides 602. The engagement surface 802 is shaped to deflect the magazine lid 220 away from the magazine housing 210 as the magazine housing 210 is pivoted about the hinge 514. In the present example, the engagement surface 802 includes a first shaped portion 812, a second shaped portion 814, and a third shaped portion 816. In some examples, the engagement surface 802 can include more or fewer shaped portions than shown in FIG. 8.

As shown in FIG. 8, the first shaped portions 812 is a curved shaped defined by a first radius (not illustrated in FIG. 8). The second shaped portion 814, spaced apart from the first shaped portion 812, is also a curved shaped defined by a second radius (not illustrated in FIG. 8). In some examples, the first and second radii can be the same or different. Alternatively, the first and second shaped portions 812, 814 are curved but the curve of the first and second shaped portions 812, 814 are not defined by a radius but another curved shape. Further, the third shaped portion 816, spaced apart from the first and second shaped portions 812, 814, is a generally straight shape. In some examples, the first, second, and third shaped portions 812, 814, 816 are differently shaped and can include a variety of regular and irregular curves and shapes. In preferred examples, the shape of the engagement surface 802 is configured to facilitate smooth movement of the guide plate 604 engaged with the housing guides 602.

The first shaped portion 812 defines an example first height 822, the second shaped portion 814 defines an example second height 824, and the third shaped portion 816 defines an example third height 826. Each of the first, second, and third heights 822, 824, 826 are variable along the length of the guide plate 604 and within the first, second, and third shaped portions 812, 814, 816. In the present example, the first height 822 is larger than the second height 824 which is larger than the third height 826. The first, second, and third heights 822, 824, 826 defines a distance between the lid 220 and the housing 210 when certain ones of the first, second, and third shaped portions 812, 814, 816 engage the housing guides 602.

INDUSTRIAL APPLICABILITY

Operation of the Magazine

Figure 9:
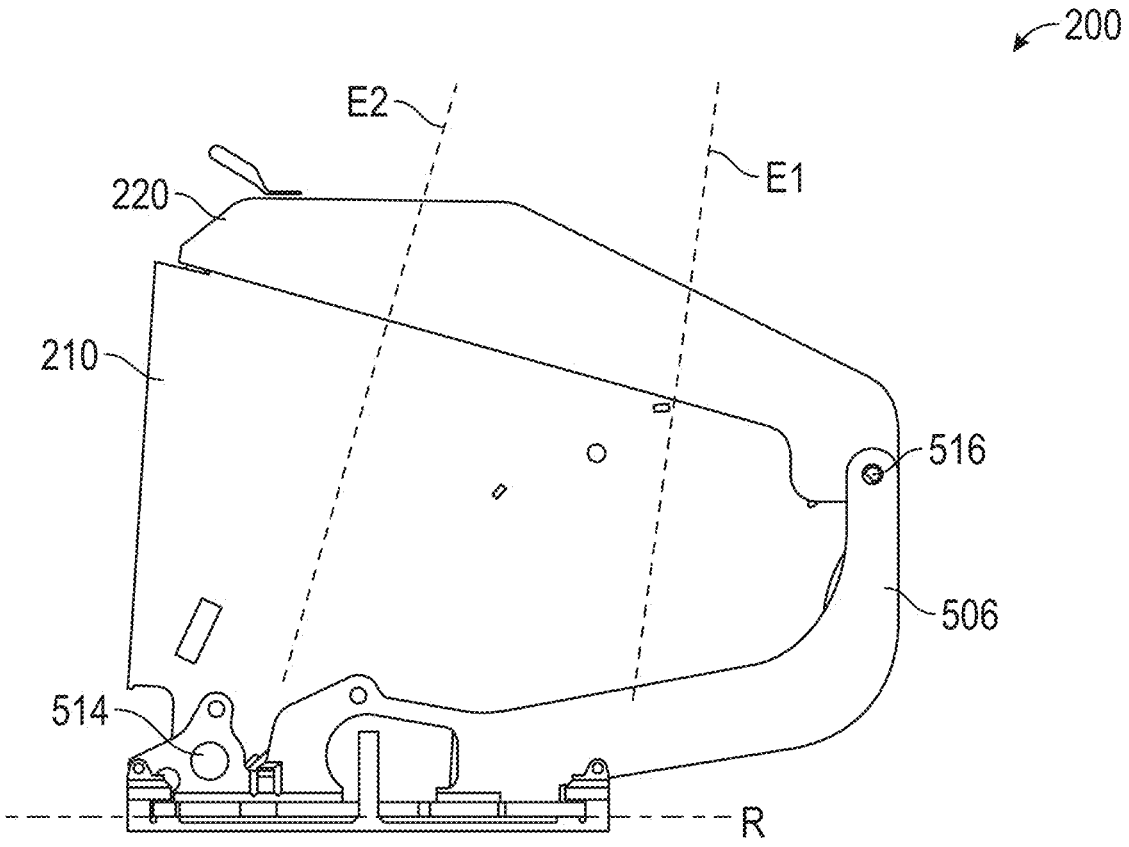
FIG. 9 is a side view of the auto-bit changer magazine of FIG. 5 in a parked position.
Figure 10:
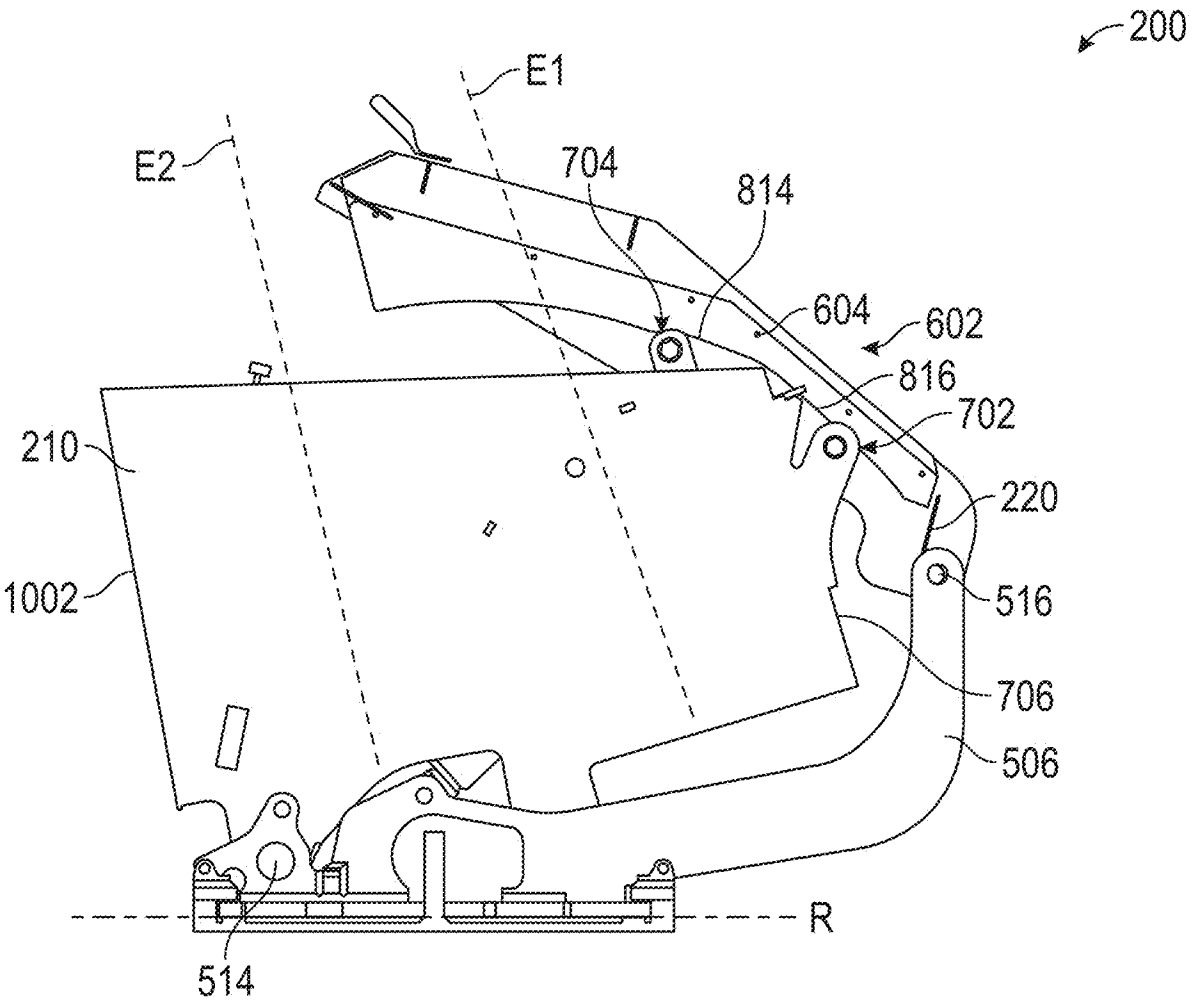
FIG. 10 is a side view of the auto-bit changer magazine of FIGS. 5 and 7 in a partially open position.
Figure 11:
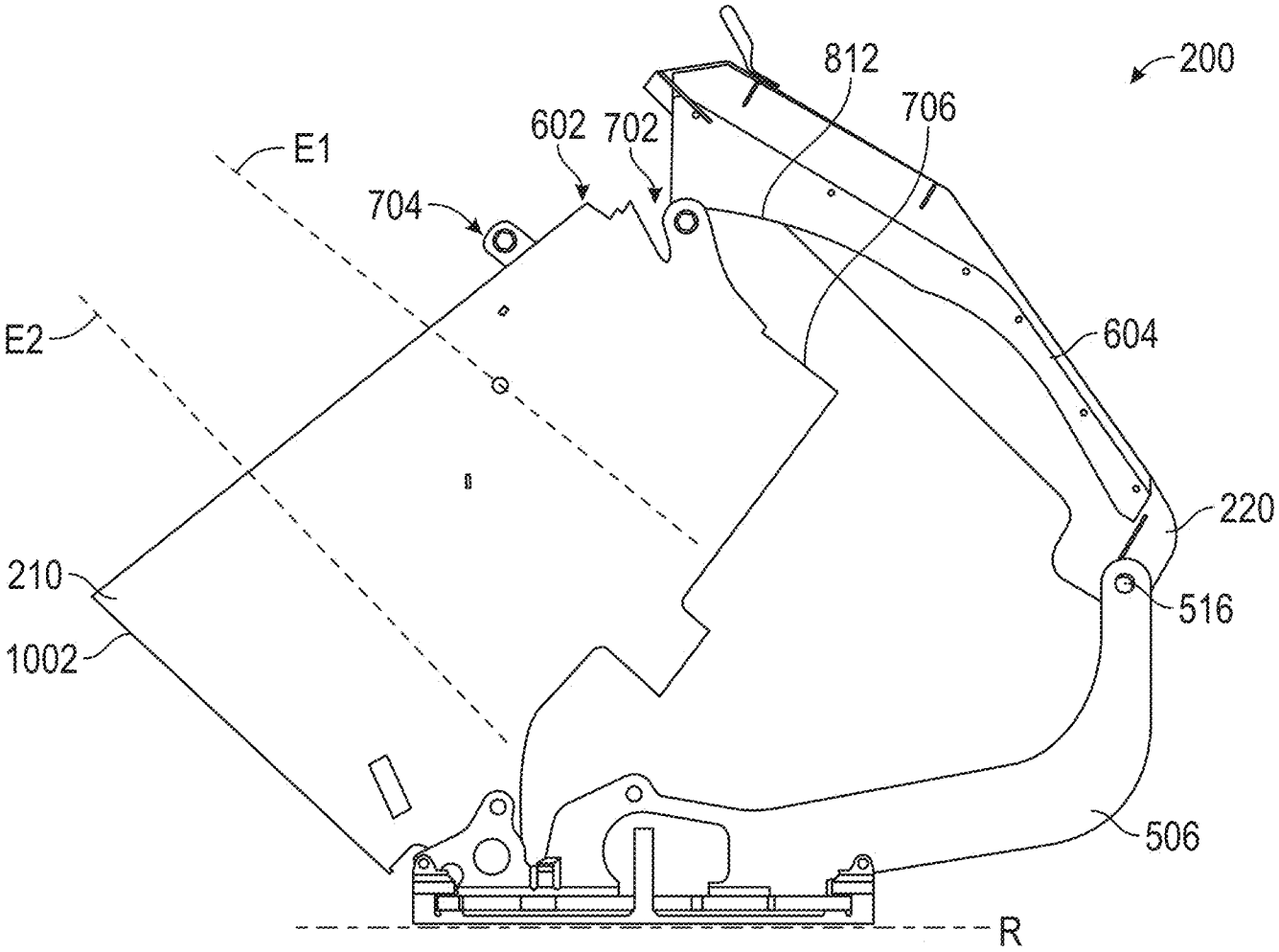
FIG. 11 is a side view of the auto-bit changer magazine of FIGS. 5 and 7 in a fully opened position.

FIGS. 9-11 illustrate the operation of the magazine 200. In some examples, the magazine 200 is actuated under the control of controller 150, but could be manually operated by a person. Operation of the magazine includes opening of the magazine 200 via actuation of the actuators 504 (shown in FIG. 5, not shown in FIGS. 9-12 for clarity). In FIG. 9, the magazine 200 is in a closed position and in FIG. 11, the magazine 200 is in a tilted, open position. FIG. 10 illustrates an example intermediary state between FIGS. 9 and 11. In preferred examples, the magazine 200 smoothly transitions from the closed position, through the intermediary state, and into the tilted, open position. However, in some examples, the magazine 200 may be configured to transition stepwise between the closed position and the tilted, open position.

As shown in FIG. 9, the lid 220 encloses the housing 210. In the parked, closed position, the magazine 200 maintains a low-profile and reduces the amount of space taken up on the platform 112. Additionally, each of the drill pockets 512 (shown in FIGS. 5 and 6) defines an engagement axis E. In the closed position, the engagement axis E extends generally vertical relative to the platform and reference axis R. In the example of FIG. 9, the engagement axis E is not aligned with the mast 130 or the drill 140 (FIG. 3). The engagement axis E of a drill-bit pocket 512 represents the axis along which drill string 144 should align with to properly engage with an engagement end 410 of a drill bit 400 held within the drill-bit pocket 512.

Turning to FIG. 10, the controller 150 activates the actuator 504. When the actuator 504 is activated, the hydraulic actuator 504 extends in length and causes the housing 210 to pivot about the hinge 514. As the lid 220 pivots about the hinge 516, the guide plate 604 engages the housing guides 602. Specifically, as the housing 210 pivots about the hinge 514, the housing guides 602 push against the guide plate 604 and, by extension, the lid 220, causing the lid 220 to pivot away from the housing 210. As shown in FIG. 10, the first housing guide 702 engages with the second shaped section 814 and the second housing guide 704 engages with the third shape section 816.

Because the hinge 514 is disposed proximate a front sidewall 1002 of the housing 210, the front sidewall 1002 rotates forward away from the lid 220. At the same time the front sidewall 1002 rotates forward, the rear sidewall 706 rotates up and towards the lid 220, causing the lid housing guides 602 to slidably engage with the guide plate 604 such that the lid 220 pivots upward about the hinge 516. As shown in FIG. 10, the engagement axis E of the drill pockets 512 are also rotating about the hinge 514. As shown in FIG. 10, the housing 210 is approximately 16 degrees (°) relative to the reference axis R. Additionally, the lid is approximately 15° relative to the reference axis R.

Turning to FIG. 11, the housing 210 is in the tilted, fully-open position. In some examples, the controller 150 ceases operation of the actuator 504 while in other examples, the actuator 504 is mechanically limited from extending beyond the tilted, fully-open position. As shown in FIG. 10, the lid 220 does not cover or enclose the housing 210. As a result, the mast 130 has access to the drill pockets 512 of the magazine 200. As shown in FIG. 11, the second housing guide 704 engages with the first shape section 812 of the guide plate 604. As a result, the lid 220 is spaced apart from the rear sidewall 706. As shown in FIG. 11, the housing 210 is approximately 50 degrees (°) relative to the reference axis R. In various examples, the tilted, open position is anywhere between approximately 40° and approximately 65°. Additionally, the lid is approximately 30° relative to the reference axis R based on the first shaped portion 812 and the first height 822 as engaged with the second housing guide 704.

Figure 12:
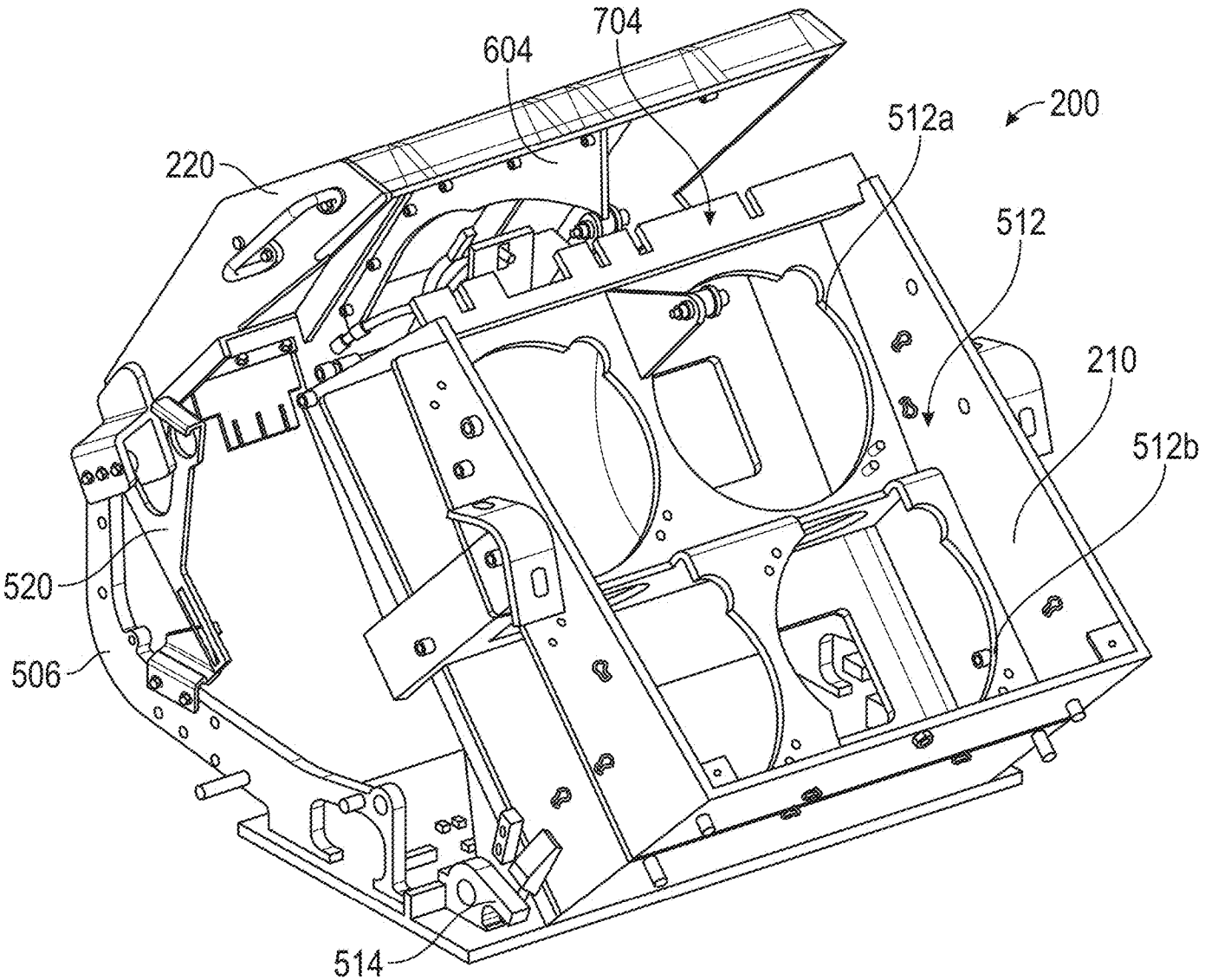
FIG. 12 is a perspective view of the auto-bit changer magazine of FIGS. 5 and 7 in the fully opened position shown in FIG. 11.

FIG. 12 illustrates the magazine 200 in an open configuration, as shown from the side view in FIG. 11. As shown in FIG. 12, each of the drill bit pockets 512 are fully accessible when the magazine is in the open configuration.

Drill Bit Changing

As discussed elsewhere herein, mast 130 is configured to rotate or tilt drill 140 between a range of angles with respect to reference axis R, for example, by itself tilting between the range of angles, under the control of controller 150. During the changing of a drill bit 400, controller 150 may control mast 130 to tilt drill 140 to align drill axis D with engagement axis E1 of the drill-bit pocket 512 (e.g., 512A or 512C) in the first row, or to align drill axis D with engagement axis E2 of the drill-bit pocket 512 (e.g., 512B or 512D) in the second row. In addition, in an embodiment with a plurality of columns of drill-bit pockets 512, controller 150 may control magazine 200 to slide within the securing channel 216, so as to align drill axis D with a particular column. Thus, controller 150 may control the angle of drill 140, the angle of the housing 210, and/or the lateral position of magazine 200 to align drill axis D with the engagement axis E of any one of the plurality of drill-bit pockets 512 in magazine 200.

The selection of the angle of drill axis D represents the selection of a particular row of drill-bit pockets 512, and the selection of the lateral position of magazine 200 represents the selection of a particular column of drill-bit pockets 512. It should be understood that the selection of a particular row and a particular column defines the intersection point of drill axis D with magazine 200 and thereby represents the selection of a particular drill-bit pocket 512.

Within each column of drill-bit pockets 512, each drill-bit pocket 512 may angle a respective drill bit 400, held within, at a different angle B with respect to reference axis R than any other drill-pocket 512 in the same column. In other words, within the column, the engagement axis E of each drill-bit pocket 512 may have a different angle than the engagement axis E of any other drill-bit pocket 512 within the same column. In general, the angles of the plurality of drill-bit pockets 512 in a column will decrease from the bottom to the top of the column. In other words, the angle of the drill-bit pocket 512 at the bottom of the column (i.e., closest to platform 112 when the magazine is in the open, tilted position) will be the largest angle for the column, and the angle B of the drill-bit pocket 512 at the top of the column (i.e., farthest from platform 112) will be the smallest angle for the column, with the angles of any drill-bit pockets 512 between the bottom and top drill-bit pockets 512 being incrementally between the largest and smallest angles.

As an example, first drill-bit pocket 512A has a first engagement axis E1, which has a first angle with respect to reference axis R, and second drill-bit pocket 512B has a second engagement axis E2, which has a second angle with respect to reference axis R. First drill-bit pocket 512A is positioned vertically below second drill-bit pocket 512B, within the same column. First drill-bit pocket 512A holds a first drill bit 400A at the first angle, for example, by being angled at the first angle B1 with respect to reference axis R. Similarly, second drill-bit pocket 512B holds a second drill bit 400B at the second angle, for example, by being angled at the second angle with respect to reference axis R. Notably, since second drill-bit pocket 512B is positioned vertically above first drill-bit pocket 512A, the second angle is smaller than the first angle.

Once drill axis D has been aligned with a particular engagement axis E of a particular drill-bit pocket 512, drill string 144 may be operated to interact with that particular drill-bit pocket 512, under the control of controller 150. In the illustrated example, drill axis D is aligned with the engagement axis E of drill-bit pocket 512D, and therefore, drill string 144 may be operated to interact with drill-bit pocket 512D. If the selected drill-bit pocket 512D is occupied by a drill bit 400 (e.g., a new drill bit 400) and no drill bit 400 is currently installed on the drilling end of drill string 144, this interaction may comprise extending drill string 144 until the drilling end of drill string 144 engages with engagement end 410 of the drill bit 400 occupying drill-bit pocket 512D, and then fixing the drill bit 400 in drill-bit pocket 512D to the drilling end of drill string 144 via an attachment mechanism, to thereby install the drill bit 400 on the drill string 144. In this case, drill string 144 may then be retracted, and mast 130 and/or drill 140 may be controlled to begin a drilling operation with the installed drill bit 400. On the other hand, if the selected drill-bit pocket 512D is empty and a drill bit 400 (e.g., a used drill bit 400) is currently installed on the drilling end of drill string 144, this interaction may comprise extending drill string 144 until drilling end 420 of the drill bit 400 is within drill-bit pocket 512D, and then releasing the drill bit 400 from drill string 144 into drill-bit pocket 512D via a release mechanism. In this case, drill string 144 may then be retracted, and mast 130, drill 140, and/or magazine 200 may be controlled to install a new drill bit 400 on the drilling end of drill string 144, as described above.

The automatic drill bit changing magazine described herein has several benefits over other drill bit magazines. First, when the magazine 200 is in the open configuration, the lid 220 allows full accessibility to the volume of the housing 210. Second, the roller guides 704 are centrally disposed to ensure equal load distribution on both hinges 516. Third, having at least two roller guides 704 provide smooth operation of the magazine 200. Fourth, the lid 220 is designed to be easier to assemble and operate than lids in other drill bit magazines. These are some of the benefits of the automatic drill bit changing magazine, but many additional benefits can be understood from the entirety of the present disclosure.

The invention claimed is:

1. A magazine for auto drill-bit changes, the magazine comprising:

a housing, defining a volume, including:

at least one sidewall defining an interior volume;

a first housing guide;

a second housing guide; and at least two drill-bit pockets disposed within the volume of the housing;

a bracket having a first end and a second end, the housing pivotably coupled to the first end of the bracket;

an actuator pivotably coupled to both the sidewall of the housing and the bracket, the actuator actuatable between a first state and a second state;

a lid dimensioned to enclose the housing, the lid pivotably coupled to the second end of the bracket; and a guide plate disposed on an underside of the lid having a first portion with a first height and a second portion, spaced apart from the first portion, having a second height smaller than the first height;

wherein the housing is actuatable between a parked, closed position and an open, tilted position when the actuator transitions from the first state to the second state, and wherein, when the housing is transitioning from the parked, closed position to the tilted, open position, the first and second portions of the guide plate engage the first and second housing guides and, when the housing is in the open, tilted position, the first portion of the guide plate engages the second housing guide.

2. The magazine for auto-drill bit changes of claim 1, wherein the at least one of the first and second housing guides includes a low-friction roller.

3. The magazine for auto-drill bit changes of claim 2, wherein the actuator is a hydraulic actuator.

4. The magazine for auto-drill bit changes of claim 3, wherein the actuator is pivotably coupled to the bracket between the first end and the second end of the bracket.

5. The magazine for auto-drill big changes of claim 1, wherein the at least one sidewall includes a first sidewall and a second sidewall spaced apart from the first sidewall by a distance, and wherein, the first housing guide and the second housing guide are disposed at approximately a midpoint between the first sidewall and the second sidewall.

6. The magazine for auto-drill bit changes of claim 5, wherein the housing rotates between 40 degrees (°) and 65° from the parked position and the tilted position.

7. The magazine for auto-drill bit changes of claim 1, wherein the first housing guide is disposed on an interior surface of a second sidewall and the second housing guide is disposed on an exterior surface of the second sidewall.

8. A drilling rig, comprising:

a machine body comprising a platform that defines a reference axis;

a mast attached to the machine body and configured to tilt a drill between a range of angles with respect to the reference axis, wherein the range of angles includes a first angle and a second angle;

one or more ground-engaging members configured to facilitate the drill engaging a ground; and the magazine of claim 1, wherein the magazine is attached to the platform and each of the one or more ground engaging members are disposed in one of the drill-bit pockets.

9. The drilling rig of claim 8, wherein the magazine includes at least four drill-bit pockets.

10. The drilling rig of claim 8, wherein the magazine is fixedly secured to the platform.

11. The drilling rig of claim 10, wherein the bracket of the magazine is fixedly secured to the platform and the housing is indirectly secured to the platform via the bracket.

12. The drilling rig of claim 8, wherein the first end of the bracket is disposed on the platform and the second end of the bracket overhangs the platform.

13. A method of auto-changing a drill bit, comprising:

determining, via a controller, to change a used drill bit with a new drill bit disposed in the magazine of claim 1;

activating the actuator of the magazine to transition the housing from the parked position to the open, tilted position; and in response to determining to change the used drill bit, selecting an empty one of the at least two drill-bit pockets of the magazine;

controlling the mast to tilt the drill to an angle, with respect to the reference axis, that matches an angle of the selected empty drill-bit pocket;

operating a drill string of the drill to release the used drill bit into the selected empty drill bit pocket;

selecting an occupied one of the at least two drill-bit pockets in the magazine;

controlling the mast to tilt the drill to an angle, with respect to the reference axis, that matches an angle of the selected occupied drill-bit pocket; and operating the drill string of the drill to engage a new drill bit held by the selected occupied drill-bit pocket.

14. The method of claim 13, wherein activating the actuator causes the housing to rotate between 40 degrees (°) and 65° from the parked position and the tilted position.

15. The method of claim 14, wherein activating the actuator causes the lid to rotate between 60 degrees (°) and 90° about the second end of the bracket.

* * * * *